US008720881B2

(12) United States Patent
Yamaguchi

(10) Patent No.: US 8,720,881 B2
(45) Date of Patent: May 13, 2014

(54) IMAGE FORMING APPARATUS AND METHOD OF CONTROLLING SAME

(71) Applicant: Kyocera Document Solutions Inc., Osaka (JP)

(72) Inventor: Kiyotaka Yamaguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/852,280

(22) Filed: Mar. 28, 2013

(65) Prior Publication Data

US 2013/0256973 A1 Oct. 3, 2013

(30) Foreign Application Priority Data

Mar. 29, 2012 (JP) ..... 2012-075944

(51) Int. Cl.
*B65H 5/26* (2006.01)

(52) U.S. Cl.
USPC ..... 271/9.06; 271/9.01

(58) Field of Classification Search
CPC ..... B65H 2301/14; B65H 2301/141; B65H 2408/113; B65H 2557/63
USPC ..... 271/9.01, 9.05, 9.06, 162, 164; 399/81, 399/88, 391
See application file for complete search history.

(56) References Cited

U.S. PATENT DOCUMENTS 6,526,253 B2 * 2/2003 Hayashi et al. ..... 399/391
7,770,880 B2 * 8/2010 Yamazaki ..... 271/9.05

FOREIGN PATENT DOCUMENTS

JP 2007-091442 A 4/2007

OTHER PUBLICATIONS

English Abstract and Translation for JP 2007-091442 A, published Apr. 12, 2007.

* cited by examiner

*Primary Examiner* — Jeremy R Severson
(74) *Attorney, Agent, or Firm* — NDQ&M Watchstone LLP

(57) ABSTRACT

An image forming apparatus is provided that can efficiently reduce power consumption. The image forming apparatus includes a power supply portion that brings, into a power saving state, a paper feed device holding a sheet of a sheet size whose paper feed frequency does not reach a threshold value and a notification portion that provides a notification that a paper feed device holding the sheet of the sheet size whose paper feed frequency reaches the threshold value is encouraged to be the paper feed device that is closer to the print portion than the paper feed device holding the sheet of the sheet size whose paper feed frequency does not reach the threshold value.

7 Claims, 5 Drawing Sheets

IMAGE FORMING APPARATUS AND METHOD OF CONTROLLING SAME

This application is based on and claims the benefit of priority from Japanese Patent Application No. 2012-075944 filed on Mar. 29, 2012, the contents of which are hereby incorporated by reference.

BACKGROUND

The present disclosure relates to an image forming apparatus including a paper feed device and a method of controlling such an image forming apparatus.

An image forming apparatus that prints an image on a sheet to output it incorporates a print portion including: an image forming portion which forms a toner image to transfer it to the sheet; a body paper feed portion that feeds the sheet to the image forming portion; and a fixing portion that fixes the toner image transferred to the sheet. A paper feed device (option device) that feeds the sheet to the print portion may be fitted to the image forming apparatus separately from the body paper feed portion.

The paper feed device takes out a sheet held in a cassette or the like, and transports the sheet to a sheet transport path connected to the print portion. Hence, in the paper feed device, a paper feed transport portion for feeding and transporting the sheet to the sheet transport path connected to the print portion is provided. The paper feed transport portion includes a roller and a motor, rotates the roller by the drive force of the motor and thereby feeds and transports the sheet. In other words, the paper feed device receives power supplied from a power supply portion to perform a paper feed transport operation.

Multi-stage paper feed devices may be fitted to the image forming apparatus. For example, multi-stage paper feed devices are stacked in an up/down direction, and the paper feed transport portions (paper feed transport paths) of the multi-stage paper feed devices are coupled to each other.

In this configuration, when a sheet held in a lower stage paper feed device than a predetermined stage is fed to the print portion, the predetermined stage paper feed device (paper feed transport portion) together with the lower stage paper feed device (paper feed transport portion) performs the paper feed transport operation of the sheet. On the other hand, when a sheet held in the predetermined stage paper feed device is fed to the print portion, it is not necessary to make the lower stage paper feed device (paper feed transport portion) than the predetermined stage perform the paper feed transport operation of the sheet. Hence, when the sheet held in the predetermined stage paper feed device is fed to the print portion, in order to reduce power consumption, it is possible to stop power supply to the lower stage paper feed device (paper feed transport portion) than the predetermined stage.

For example, it is assumed that a paper feed device which holds the sheet of a frequently used sheet size is the uppermost stage paper feed device (the paper feed device close to the print portion). In this case, the uppermost stage paper feed device feeds the sheet more frequently (only the uppermost stage paper feed device is made to perform the paper feed transport operation for a longer period of time). Hence, it is possible to stop the power supply to the second and subsequent paper feed devices (paper feed transport portions) for a longer period of time. Consequently, the effect of power saving is enhanced.

However, in general, the sheet size of sheet that can be held in each of the multi-stage paper feed devices can be changed. Hence, the paper feed device that holds the sheet of the frequently used sheet size is not always the uppermost stage paper feed device. For example, the paper feed device that holds the sheet of the frequently used sheet size may be the lowermost stage paper feed device. In this case, the lowermost stage paper feed device feeds the sheet more frequently. When the lowermost stage paper feed device feeds the sheet, since it is necessary to make the other paper feed devices (paper feed transport portions) perform the paper feed transport operation of the sheet, it is impossible to stop the power supply to the other paper feed devices (paper feed transport portions). Consequently, it is impossible to obtain the effect of power saving.

SUMMARY

The present disclosure is made to solve the above problem; an object of the present disclosure is to provide an image forming apparatus that can efficiently reduce power consumption and a method of controlling the image forming apparatus.

To achieve the above object, according to the present disclosure, there is provided an image forming apparatus including a print portion, multi-stage paper feed devices, a sheet size detection portion, a storage portion, a power supply portion and a notification portion. The print portion prints an image on a sheet. The multi-stage paper feed devices hold the sheet and feeds the sheet held to the print portion. The sheet size detection portion detects a sheet size of the sheet held in each of the multi-stage paper feed devices. The storage portion stores paper feed frequency data indicating a paper feed frequency to the print portion per sheet size. The power supply portion performs, when the paper feed device holding the sheet of a sheet size whose paper feed frequency reaches a predetermined threshold value is the paper feed device, among the multi-stage paper feed devices, that is closer to the print portion than the paper feed device holding the sheet of a sheet size whose paper feed frequency does not reach the threshold value, normal power supply on the paper feed device holding the sheet of the sheet size whose paper feed frequency reaches the predetermined threshold value, and limits, as compared with the normal power supply, power supply to the paper feed device holding the sheet of the sheer size whose paper feed frequency does not reach the threshold value so as to bring, into a power saving state, the paper feed device holding the sheet of the sheet size whose paper feed frequency does not reach the threshold value. The notification portion provides a notification that the paper feed device holding the sheet of the sheet size whose paper feed frequency reaches the threshold value is encouraged to be the paper feed device that is closer to the print portion than the paper feed device holding the sheet of the sheet size whose paper feed frequency does not reach the threshold value.

DETAILED DESCRIPTION

Figure 1:
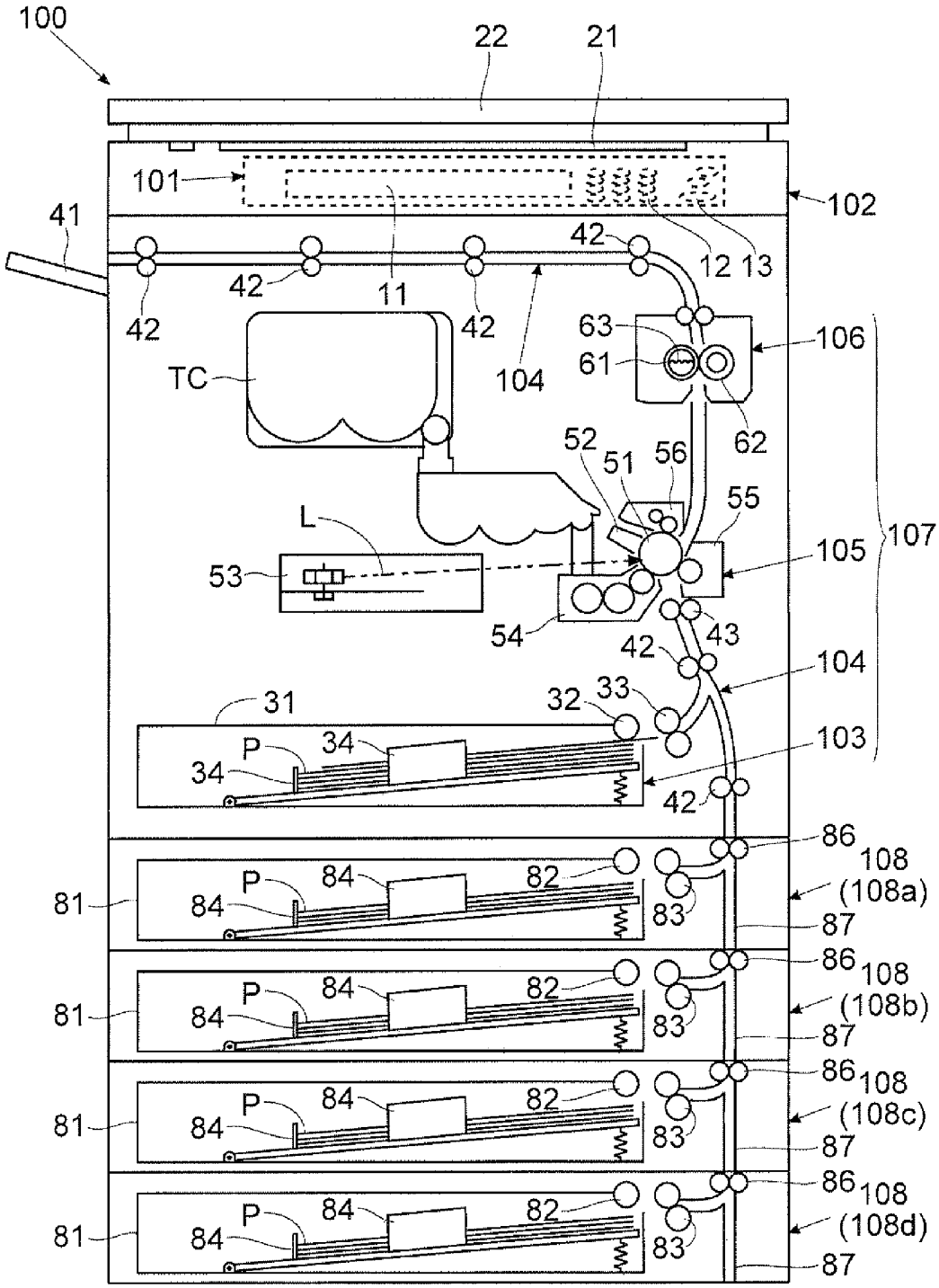
FIG. 1 is a schematic diagram of an image forming apparatus according to an embodiment of the present disclosure.

Overall Configuration of an Image Forming Apparatus

The overall configuration of an image forming apparatus 100 according to an embodiment of the present disclosure will first be described with reference to FIG. 1.

The image forming apparatus 100 of the present embodiment is a multifunctional machine that can perform a plurality of types of jobs such as a copying machine, a printer, a scanner and a facsimile. The image forming apparatus 100 includes an operation panel 101 (corresponding to a "notification portion", a "display portion", an "operation portion" and an "operation display portion"), an image reading portion 102 and an engine portion 107 (corresponding to a "print portion").

The operation panel 101 includes a liquid crystal display portion 11 whose display surface is covered by a touch panel. On the liquid crystal display portion 11, a setting key (soil key) for receiving the change of a setting value is displayed, and a message indicating the state of the device or the like is also displayed. Moreover, in the operation panel 101, as hard keys, a numeric key 12 for receiving the input of a value, a start key 13 for receiving an instruction to start the execution of a job and the like are provided.

The image reading portion 102 reads an original document to generate image data. In the image reading portion 102, although not illustrated, optical system members such as an exposure lamp, a mirror, a lens and an image sensor are provided. The image reading portion 102 applies light to the original document placed on a placement reading contact glass 21, performs A/D conversion on an output value of the image sensor receiving light reflected off the original document and thereby generates the image data. Thus, it is possible to perform printing based on the image data obtained through the performance of an operation (scan operation) of reading the original document by the image reading portion 102. It is also possible to store the image data obtained by the scan operation. Moreover, in the image reading portion 102, an original document pressing portion 22 for pressing the original document placed on the placement reading contact glass 21 is provided.

The engine portion 107 is a mechanism portion that is necessary to execute jobs involving the printing, and includes a body paper feed portion 103, a sheet transport portion 104, an image forming portion 105 and a fixing portion 106.

The body paper feed portion 103 includes a cassette 31 that holds sheet P, and feeds the sheet P within the cassette 31 to the sheet transport portion 104. In the body paper feed portion 103, a pickup roller 32 for taking out the sheet P within the cassette 31, a separation roller pair 33 for reducing the feeding of a plurality of sheets P and the like are provided.

Moreover, in the body paper feed portion 103, a restriction guide 34 that is pressed onto a side surface (or a side surface of a sheet stack where a plurality of sheets P are stacked) of the sheet P within the cassette 31 is provided. The restriction guide 34 is attached to the cassette 31, and is slidable in a direction of paper feed or in a direction perpendicular to the direction of paper feed. Hence, when the restriction guide 34 is glided in the slidable direction (in the direction of paper feed or in the direction perpendicular to the direction of paper feed), the sheet size of the sheet P that can be held in the cassette 31 can be changed. In other words, the sheet size of the sheet P that can be held in the cassette 31 is determined by the position of the restriction guide 34 in the slidable direction.

In order to detect the sheet size (the sheet size of the sheet P that can be held in the cassette 31) of the sheet P within the cassette 31, a sheet size detection sensor 35 (see FIG. 2) is provided in the body paper feed portion 103. The sheet size detection sensor 35 is a sensor that changes its output according to the position of the restriction guide 34 in the slidable direction. The output of the sheet size detection sensor 35 is received by an engine control portion 140 (see FIG. 2), which will be described later. Then, the engine control portion 140 detects, based on the output of the sheet size detection sensor 35, the sheet size of the sheet P within the cassette 31, and transmits the result of the detection to a main control portion 110 (see FIG. 2), which will be described later. Thus, the main control portion 110 can detect the sheet size of the sheet P held in the body paper feed portion 103.

The sheet transport portion 104 transports the sheet P within the device. Specifically, the sheet P fed from the body paper feed portion 103 is made to pass through the image forming portion 105 and the fixing portion 106 in this order, and is guided to an ejection tray 41 by the sheet transport portion 104. In the sheet transport portion 104, a plurality of transport roller pairs 42 that transport the sheet P are provided. Furthermore, a resist roller pair 43 is provided that places the sheet P on standby in front of the image forming portion 105 and that feeds it out to the image forming portion 105 with appropriate timing.

The image forming portion 105 forms a toner image based on the image data, and transfers the toner image to the sheet P. The image forming portion 105 includes a photosensitive drum 51, a charging device 52, an exposure device 53, a development device 54, a transfer roller 55 and a cleaning device 56.

In a toner image formation process and a toner image transfer process, the photosensitive drum 51 is first driven and rotated, and the surface of the photosensitive drum 51 is charged with the charging device 52 so as to have a predetermined potential. The exposure device 53 outputs a light beam L based on the image data, and scans and exposes the surface of the photosensitive dram 51. Thus, an electrostatic latent image is formed on the surface of the photosensitive drum 51. The development device 54 receives toner from a toner container TC, feeds the toner to the electrostatic latent image formed on the surface of the photosensitive drum 51 and develops it.

The transfer roller 55 can be pressed by pressure onto the surface of the photosensitive drum 51 and be rotated. A predetermined voltage is applied to the transfer roller 55. In this state, the resist roller pair 43 makes the sheet P enter between the transfer roller 55 and the photosensitive drum 51 with appropriate timing. Thus, the toner image on the surface of the photosensitive dram 51 is transferred to the sheet P. Then, after the completion of the toner image transfer process, the cleaning device 56 removes the toner left on the surface of the photosensitive drum 51 and the like.

The fixing portion 106 heats and pressurizes the toner image transferred to the sheet P and thereby fixes it. The fixing portion 106 includes a heating roller 61 and a pressurizing roller 62. The heating roller 61 incorporates a heater 63. The pressurizing roller 62 is pressed by pressure onto the heating roller 61. The sheet P to which the toner image has been transferred passes between the heating roller 61 and the pressurizing roller 62, and thus is heated and pressurized. Thus, the toner image is fixed to the sheet P, and the printing is completed. Thereafter, the sheet P on which the printing has been performed is fed to the election tray 41 by the transport roller pair 42.

The image forming apparatus 100 of the present embodiment also has, separately from the body paper feed portion 103, in the engine portion 107, a paper feed device 108 that feeds the sheet P. For example, the paper feed device 108 is an option device that is removable from the image forming apparatus 100. The paper feed device 108 may be separately attached to the image forming apparatus 100 after the shipment of the device or may be previously fitted to the image forming apparatus 100 at the time of the shipment of the device.

The paper feed device 108 is arranged below the engine portion 107 (the body paper feed portion 103), and includes a cassette 81 that holds the sheet P. The paper feed device 108 includes a pickup roller 82, a separation roller pair 83 and a restriction guide 84. The paper feed device 108 has the same structure as the body paper feed portion 103; the pickup roller 82, the separation roller pair 83 and the restriction guide 84 of the paper feed device 108 have the same functions as the pickup roller 32, the separation roller pair 33 and the restriction guide 34 of the body paper feed portion 103.

In the paper feed device 108, the same sheet size detection sensor 85 (see FIG. 2) as the sheet size detection sensor 35 of the body paper feed portion 103 is provided. The output of the sheet size detection sensor 85 is received by the engine control portion 140 (see FIG. 2), which will be described later. The engine control portion 140 that has received the output of the sheet size detection sensor 85 detects the sheet size of the sheet P within the cassette 81, and transmits the result of the detection to the main control portion 110 (see FIG. 2), which will be described later. Thus, the main control portion 110 can detect the sheet size of the sheet P held in the paper feed device 108. The sheet size detection sensor 85 and the main control portion 110 (the engine control portion 140) to which the sheet size detection sensor 85 is connected correspond to a "sheet state detection portion."

In the paper feed device 108, a paper feed transport portion 87 connected to the engine portion 107 (the sheet transport portion 104) is provided. Thus, the sheet P that has been taken out of the cassette 81 is fed to the engine portion 107 by the paper feed transport portion 87 and a transport roller pair 86.

Here, in the present embodiment, multi-stage paper feed devices 108 are stacked in an up/down direction, the paper feed transport portions 87 of the paper feed devices 108 are coupled to each other and the multi-stage paper feed devices 108 are fitted to the image forming apparatus 100. Thus, the image forming apparatus 100 can simultaneously hold a plurality of types of sheets P having different sheet sizes.

For example, the paper feed transport portions 87 of the multi-stage paper feed devices 108 are coupled to each other, and thus one paper feed transport path is formed that connects from the lowermost stage paper feed device 108 through the paper feed devices of the individual stages to the uppermost stage paper feed device 108. Then, the one paper feed transport path through the multi-stage paper feed devices 108 finally connects to the sheet transport path of the sheet transport portion 104. The sheet P fed from each of the multi-stage paper feed devices 108 passes through the common paper feed path of each stage to reach the sheet transport portion 104.

Although FIG. 1 shows, as an example, a case where the four-stage paper feed devices 108 are fitted to the image forming apparatus 100, the number of paper feed devices 108 fitted to the image forming apparatus 100 is not particularly limited. For convenience, a description may be given below by sequentially representing the paper feed devices 108 from the uppermost stage (first stage) paper feed device 108 to the lowermost stage (fourth stage) paper feed device 108 by symbols 108*a*, 108*b*, 108*c* and 108*d*.

In a case where the multi-stage paper feed devices 108 are fitted to the image forming apparatus 100, when the sheet P held in a lower stage paper feed device 108 than a predetermined stage is fed to the engine portion 107, the predetermined stage paper feed device 108 together with lower stage paper feed device 108 also performs the paper feed transport on the sheet P. For example, when the sheet P held in the lowermost stage paper feed device 108*d* is fed to the engine portion 107, the sheet P from the lowermost stage paper feed device 108*d* is sequentially transported by the third stage paper feed device 108*c* and the second stage paper feed device 108*b* to the engine portion 107, and finally, the sheet P from the lowermost stage paper feed device 108*d* is fed to the engine portion 107 by the uppermost stage paper feed device 108*a*.

On the other hand, for example, when the sheet P held in the third stage paper feed device 108*c* is fed to the engine portion 107, it is not necessary to make the lowermost stage paper feed device 108*d* perform the paper feed transport on the sheet P. Likewise, when the sheet P held in the second stage paper feed device 108*b* is fed to the engine portion 107, it is not necessary to make the lowermost stage paper feed device 108*d* and the third stage paper feed device 108*c* perform the paper feed transport on the sheet P; when the sheet P held in the uppermost stage paper feed device 108*a* is fed to the engine portion 107, it is not necessary to make the lowermost stage paper feed device 108*d*, the third stage paper feed device 108*c* and the second stage paper feed device 108*b* perform the paper feed transport on the sheet P

Hardware Configuration of the Image Forming Apparatus

The hardware configuration of the image forming apparatus 100 will now be described.

Figure 2:
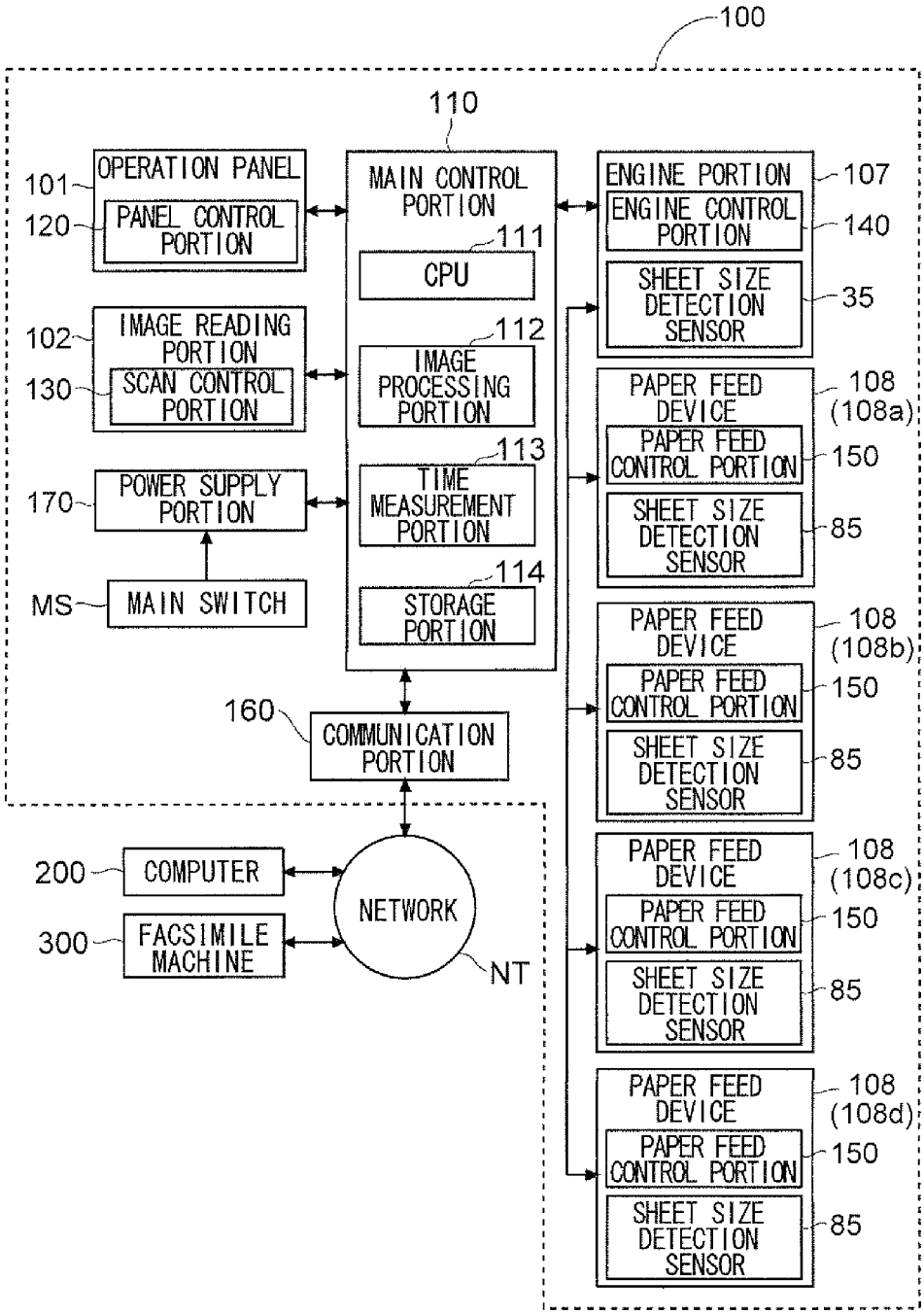
FIG. 2 is a block diagram showing the hardware configuration of the image forming apparatus shown in FIG. 1.

As shown in FIG. 2, the image forming apparatus 100 includes the main control portion 110; the main control portion 110 includes a CPU 111, which is a central processing unit an image processing portion 112, a time measurement portion 113 and a storage portion 114. The image processing portion 112 is formed with an ASIC for image processing, a memory and the like, and performs various types of image processing (such as enlargement/reduction, density conversion and data format conversion) on the image data. The time measurement portion 113 measures various types of time. The storage portion 114 is formed with a ROM, a RAM, a HDD and the like; for example, a program and data necessary for the execution of a job are stored in the ROM, and the program and the data are expanded to the RAM.

The main control portion 110 is connected to a panel control portion 120 including a CPU, a memory and the like. The panel control portion 120 receives an instruction from the main control portion 110, and controls the display operation of the operation panel 101.

Figure 3:
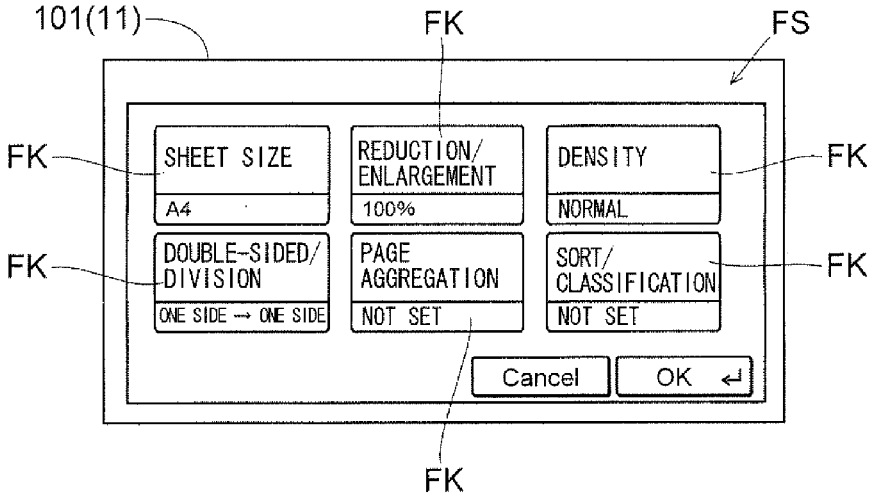
FIG. 3 is a diagram showing an example of a screen (function setting screen) displayed on an operation panel of the image forming apparatus shown in FIG. 1.

For example, as shown in FIG. 3, the panel control portion 120 displays, on the operation panel 101, a function setting screen FS corresponding to a plurality of types of jobs. As an example, FIG. 3 shows the function setting screen FS corresponding to a copy job. For example, on the function setting screen FS corresponding to the copy job, a plurality of function setting keys FKs are provided to which the names of functions such as sheet selection, reduction/enlargement, density, double-sided/division, page aggregation and sort/classification are given.

Figure 4:
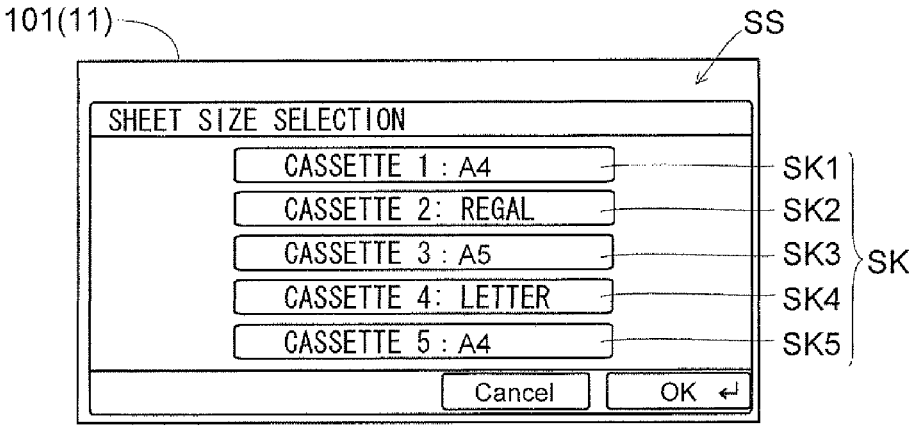
FIG. 4 is a diagram showing an example of a screen (setting value input screen) displayed on the operation panel of the image forming apparatus shown in FIG. 1.

On the function setting screen FS corresponding to the copy job, when any one of the function setting keys FKs is pressed down, the panel control portion 120 displays, as shown in FIG. 4, a setting value input screen SS corresponding to the function setting key FK pressed down, on the operation panel 101. As an example, FIG. 4 shows the setting value input screen SS when the function setting key FK named "sheet size" is pressed down.

On this setting value input screen SS, in order to receive an instruction to select the sheet size, a plurality of sheet size selection keys SK (SK1 to SK5) are provided. For example, the display name of the sheet size selection key SK1 is the sheet size of the sheet P held in the body paper feed portion 103. The display names of the sheet size selection keys SK2 to SK5 are respectively the sheet sixes of the sheets P held in the paper feed devices 108*a* to 108*d*. When the sheet size selection key SK1 is pressed down, and then an OK key is pressed down, the body paper feed portion 103 is set at the paper feed device that performs paper feed at the time of printing (the sheet size is set at the A4 size). Likewise, when any one of the sheet size selection keys SK2 to SK5 is pressed down, the paper feed device 108 corresponding to the sheet size selection key SK pressed down is set at the paper feed device that performs paper teed at the time of printing (if the sheet size selection key SK2 is pressed down, the sheet size is set at the regal size, and the paper feed device 108*a* is set at the paper feed device that performs paper feed at the time of printing).

When the sheet size of the sheet P held in the body paper feed portion 103 is changed, according to the change, the display name of the sheet size selection key SK1 corresponding to the body paper feed portion 103 is changed. For example, when the sheet size of the sheet P held in the body paper feed portion 103 is changed to A3, the display name of the sheet size selection key SK1 corresponding to the body paper feed portion 103 is changed from the A4 to the A3. Likewise, when the sheet size of the sheet P held in any one of the paper feed devices 108*a* to 108*d* is changed, according to the change, the display name of the corresponding sheet size selection key SK is changed (if the sheet size of the sheet P held in the paper feed portion 108*a* is changed to the A4, the display name of the sheet size selection key SK2 is changed to the A4).

With reference back to FIG. 2, the main control portion 110 is connected to a scan control portion 130 including a CPU, a memory and the like. The scan control portion 130 receives an instruction from the main control portion 110 to control the scan operation of the image reading portion 102.

Moreover, the main control portion 110 is connected to the engine control portion 140 including a CPU, a memory and the like. The engine control portion 140 receives an instruction from the main control portion 110 to control the print operation of the engine portion 107 (the body paper feed portion 103, the sheet transport portion 104, the image forming portion 105 and the fixing portion 106).

The engine control portion 140 is connected to a paper feed control portion 150 that is provided in each of the multi-stage paper feed devices 108. An instruction from the main control portion 110 is transmitted through the engine control portion 140 to each paper feed control portion 150 (the engine control portion 140 gives an instruction to each paper feed control portion 150). Then, the main control portion 110 gives an instruction to the engine control portion 140, and each paper feed control portion 150 is made to control the paper feed operation of the multi-stage paper feed devices 108. The main control portion 110 communicates with each paper feed control portion 150 through the engine control portion 140, and recognizes the paper feed devices 108 fitted to the image forming apparatus 100.

The main control portion 110 is connected to a communication portion 160. The communication portion 160 is connected to an external computer 200 through a network NT such that it can perform communication. Thus, it is possible to perform printing based on image data transmitted from the computer 200, and it is also possible to transmit the image data obtained by the scan operation to the computer 200. Furthermore, the communication portion 160 incorporates a modem, and thereby can perform facsimile communication with an external facsimile machine 300 through the network NT such as a telephone line.

The main control portion 110 is also connected to a power supply portion 170. The power supply portion 170 is connected to a commercial power supply, and generates a voltage necessary for operating the individual portions of the device. Turning on and off of power supply to the individual portions of the device is performed by operating a main switch MS.

Power Supply Operation, Based on Paper Feed Frequency

A power supply operation based on paper feed frequency will now be described.

In the present embodiment, the main control portion 110 stores, in the storage portion 114, paper feed frequency data indicating a paper feed frequency to the engine portion 107 per sheet size. For example, the paper feed frequency per sheet size can be determined based on the number (paper feed number) of sheets P fed from each of the multi-stage paper feed devices 108 to the engine portion 107. Incidentally, when the sheets P of the same size are held in separate paper feed devices 108, if the orientations of the sheets P placed on the cassette 81 (for example, the sheet P may be placed in portrait orientation or in landscape orientation) are different, the paper feed frequencies may differ from each other even if the sheet size is the same. Hence, when the sheets P of the same size are held in separate paper feed devices 108, in order to determine the paper feed frequency, it is preferable to consider not only the sheet size but also the orientation of the sheet P placed on the cassette 81. The main control portion 110 determines that the paper feed frequency (paper feed number) of a sheet size which reaches a predetermined threshold value is high, and that the paper feed frequency of a sheet size which does not reach the threshold value is low. The number of times of the execution of the print job is counted per sheet size, and the paper feed frequency may be determined based on the number of times of the execution of the print job per sheet size.

When a paper feed device holding the sheet P of a sheet size whose paper feed frequency reaches the threshold value (high paper feed frequency sheet size) is a higher stage paper feed device 108, among the multi-stage paper feed devices 108, that is closer to the engine portion 107 than the paper feed device 108 holding the sheet P of a sheet size whose paper feed frequency does not reach the threshold value, the power supply portion 170 performs normal power supply on the paper feed device 108 holding the sheet P of the sheet size whose paper feed frequency reaches the threshold value, among the multi-stage paper feed devices 108. Moreover, in this case, among the multi-stage paper feed devices 108, the power supply portion 170 limits, as compared with the normal power supply, the power supply to the paper feed device 108 holding the sheet P of the sheet size whose paper feed frequency does not reach the threshold value (low paper feed frequency sheet size), and thereby brings, into a power saving state (sleep state), the paper feed device 108 holding the sheet P of the sheet size whose paper feed frequency does not reach the threshold value.

For example, it is assumed that, when power is supplied to the image forming apparatus 100, the paper feed device holding the sheet P of the sheet size whose paper feed frequency reaches the threshold value is only the uppermost stage paper feed device 108*a* (the second and subsequent stage paper feed devices 108*b* to 108*d* hold the sheets P of the sheet sizes whose paper feed frequency does not reach the threshold value). In this case, the power supply portion 170 performs the normal power supply on the uppermost stage paper feed device 108*a*, and limits the power supply to the second and subsequent stage paper feed devices 108*b* to 108*d*, and thereby brings the second and subsequent stage paper feed devices 108*b* to 108*d* into the power saving state.

As another example, it is assumed that, when power is supplied to the image forming apparatus 100, the paper feed devices holding the sheet P of the sheet size whose paper feed frequency reaches the threshold value is two paper feed devices 108, that is, the uppermost stage paper feed device 108*a* and the second stage paper feed device 108*b* (the third and subsequent stage paper feed devices 108*c* and 108*d* hold the sheets P of the sheet sizes whose paper feed frequency does sot reach the threshold value). In this case, the power supply portion 170 performs the normal power supply on the uppermost stage paper feed device 108*a* and the second stage paper feed device 108*b*, and limits the power supply to the third and subsequent stage paper feed devices 108*c* and 108*d*, and thereby brings the third and subsequent stage paper feed devices 108*c* and 108*d* into the power saving state.

Among the multi-stage paper feed devices 108, the power supply portion 170 does not completely stop the power supply to the paper feed device 108 in the power saving state. Specifically, the power supply portion 170 stops the power supply to a motor (not shown) for rotating various rotary members such as the pickup roller 82. On the other hand, the power supply portion 170 continues to perform the power supply on the paper feed control portion 150 corresponding to the paper feed device 108 in the power saving state, among the multi-stage paper feed devices 108. In other words, among the multi-stage paper feed devices 108, the paper feed device 108 (the paper feed control portion 150) in the power saving state can communicate with the main control portion 110.

In this way, even if the paper feed device 108 in the power saving state is present among the multi-stage paper feed devices 108, the main control portion 110 recognizes that the paper feed device 108 in the power saving state is fitted. Hence, when an instruction to set the sheet size is received (when the setting value input screen SS (see FIG. 4) for receiving the instruction to select the sheet size is displayed on the operation panel 101), it is possible to provide, on the setting value input screen SS, not only the sheet size selection keys SK corresponding to the paper feed device 108 receiving the normal power supply but also the sheet size selection key SK corresponding to the paper feed device 108 in the power saving state. When the sheet size received by the operation panel 101 is the same as the sheet size of the sheet P held in the paper feed device 108 in the power saving state, the power supply portion 170 returns the power supply to the paper feed device 108 in the power saving state to the normal power supply.

Operation of Notifying the Recommended Sizes of the Sheets P Held in the Multi-Stage Paper Feed Devices An operation of notifying the recommended sizes of the sheets P held. In the multi-stage paper feed devices will now be described.

When power is supplied to the image forming apparatus 100, the paper feed device holding the sheet P of the sheet size whose paper feed frequency reaches the threshold value may be a lower stage paper feed device 108, among the multi-stage paper feed devices 108, than the paper feed device 108 holding the sheet P of the sheet size whose paper feed frequency does not reach the threshold value. In this case, among the multi-stage paper feed devices 108, it is impossible to bring, into the power saving state, the paper feed device 108 holding the sheet P of the sheet size whose paper feed frequency does not reach the threshold value, with the result that it is impossible to expect the effect of power saving.

Hence, if when power is supplied to the image forming apparatus 100, the paper feed device holding the sheet P of the sheet size whose paper feed frequency reaches the threshold value is a lower stage paper feed device 108, among the multi-stage paper feed devices 108, than the paper feed device 108 holding the sheet P of the sheet size whose paper feed frequency does not reach the threshold value, the operation panel 101 provides a notification that the paper feed device holding the sheet P of the sheet size whose paper feed frequency reaches the threshold value is encouraged to be a higher stage paper feed device 108, among the multi-stage paper feed devices 108, that is closer to the engine portion 107 than the paper feed device 108 holding the sheet P of the sheet size whose paper feed frequency does not reach the threshold value.

Figure 5:
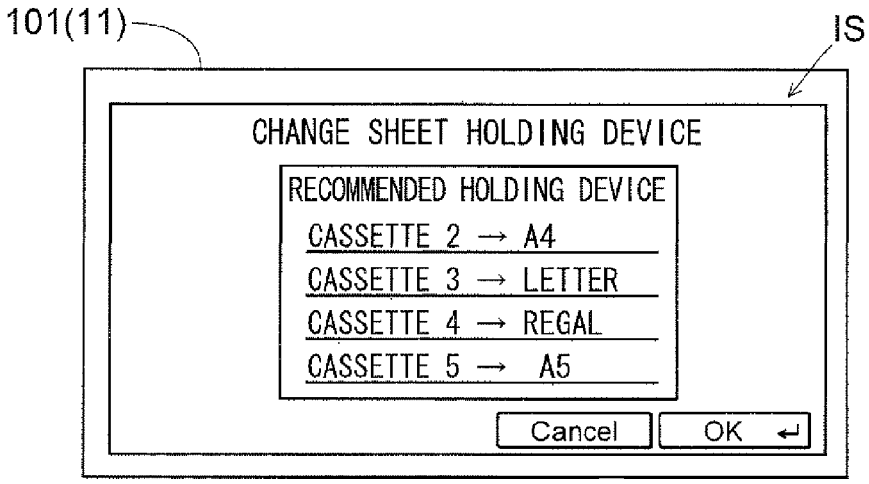
FIG. 5 is a diagram showing an example of a screen (notification screen) displayed, on the operation panel of the image forming apparatus shown in FIG. 1.

For example, it is assumed that the sheets P of the regal size, the A5 size, the letter size and the A4 size are held in the multi-stage paper feed devices 108. Furthermore, it is assumed that the number of sheets P of the regal size which have been fed is zero, the number of sheets P of the A5 size which have been fed is zero, the number of sheets P of the letter size which have been fed is 21 and the number of sheets P of the A4 size which have been fed is 60. In this case, the operation panel 101 displays a notification screen IS as shown in FIG. 5. Specifically, the operation panel 101 displays information indicating that the sheet size of the sheet P to be held in the uppermost stage paper feed device 108*a* (in FIG. 5, cassette 2) is the A4 side, the sheet size of the sheet P to be held in the second stage paper feed device 108*b* (in FIG. 5, cassette 3) is the letter size, the sheet size of the sheet P to be held in the third stage paper feed device 108*c* (in FIG. 5, cassette 4) is the legal size and the sheet size of the sheet P to be held in the lowermost stage paper feed device 108*d* (in FIG. 5, cassette 5) is the A5 size. In other words, the operation panel 101 provides a notification that the sheet P of a higher paper feed frequency sheet size is encouraged to be held in a higher stage paper feed device 108 that is closer to the engine portion 107 among the multi-stage paper feed devices 108.

Then, based on the output of the sheet size detection sensor 85, the main control, portion 110 determines whether or not the sheet sizes of the sheets P held in the multi-stage paper feed devices 108 are changed according to the details of the notification on the operation panel 101 (the information on the notification screen IS). As a result of the determination, when the sheet sizes of the sheets P held in the multi-stage paper feed devices 108 are changed according to the details of the notification, the main control portion 110 instructs the operation panel 101 to stop displaying the notification screen IS. Thus, the operation panel 101 stops displaying the notification screen IS, and displays a screen (for example, the function setting screen FS corresponding to the copy job shown in FIG. 3) that is set as the initial screen. In this way, the operation panel 101 is brought into a state where it can receive an instruction to change the setting value or an instruction to start the execution of the job.

Setting of Whether or Not the Power Supply Based on the Paper Feed Frequency is Performed A method of setting whether or not the power supply based on the paper feed frequency is performed will now be described.

Figure 6:
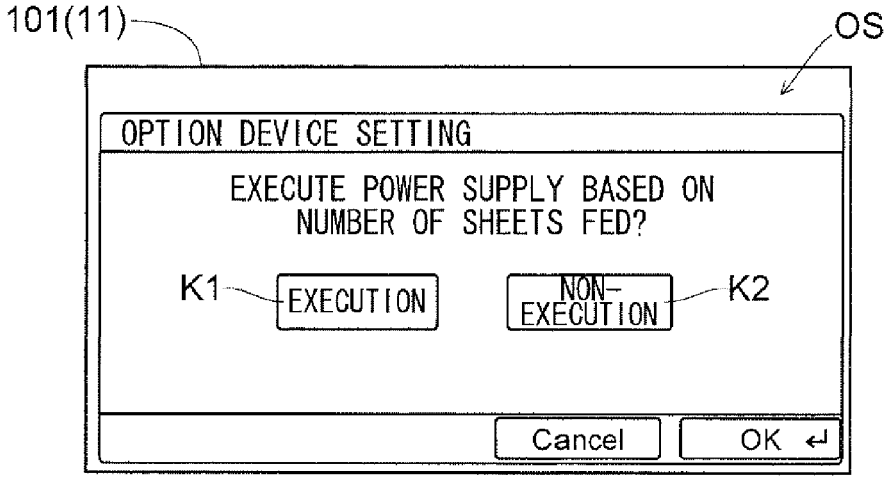
FIG. 6 is a diagram showing an example of a screen (option device setting screen) displayed on the operation panel of the image forming apparatus shown in FIG. 1.

The operation panel 101 receives whether or not the power supply to the multi-stage paper feed devices 108 based on the paper feed frequency is performed. The power supply to the multi-stage paper feed devices 108 based on the paper feed frequency means that, among the multi-stage paper feed devices 108, the normal power supply is performed on the paper feed device 108 holding the sheet P of the sheet size whose paper feed frequency reaches the threshold value, and that the paper feed device 108 holding the sheet P of the sheet size whose paper feed frequency does not reach the threshold value is brought into the power saving state. For example, when the operation panel 101 receives whether or not the power supply to the multi-stage paper feed devices 108 based on the paper feed frequency is performed, the operation panel 101 displays an option device setting screen OS as shown in FIG. 6. Then, when an execution key K1 on the option, device setting screen OS is pressed down, the main control portion 110 instructs the power supply portion 170 to perform, the power supply to the multi-stage paper feed devices 108 based on the paper teed frequency when power is subsequently supplied to the image forming apparatus 100. On the other hand, when a non-execution key K2 on the option device setting screen OS is pressed down, the main control portion 110 instructs the power supply portion 170 not to perform the power supply to the multi-stage paper feed devices 108 based on the paper feed frequency.

Furthermore, the operation panel 101 receives the interruption of the power supply to the multi-stage paper feed devices 108 based on the paper feed frequency. Specifically, even while the power supply to the multi-stage paper reed devices 108 based on the paper feed frequency is being performed, if the operation, panel 101 receives information that the power supply to the multi-stage paper feed devices 108 based on the paper feed frequency is interrupted (for example, if the non-execution key K2 on the option device setting screen OS is pressed down), the main control portion 110 returns, among the multi-stage paper feed devices 108, the power supply to the paper feed device 108 in the power saving state to the normal power supply.

Flow when the Power Supply Based on the Paper Feed Frequency is Performed

A flow when the power supply to the multi-stage paper feed devices 108 based on the paper feed frequency is performed will now be described according to a flowchart shown in FIG. 7.

Figure 7:
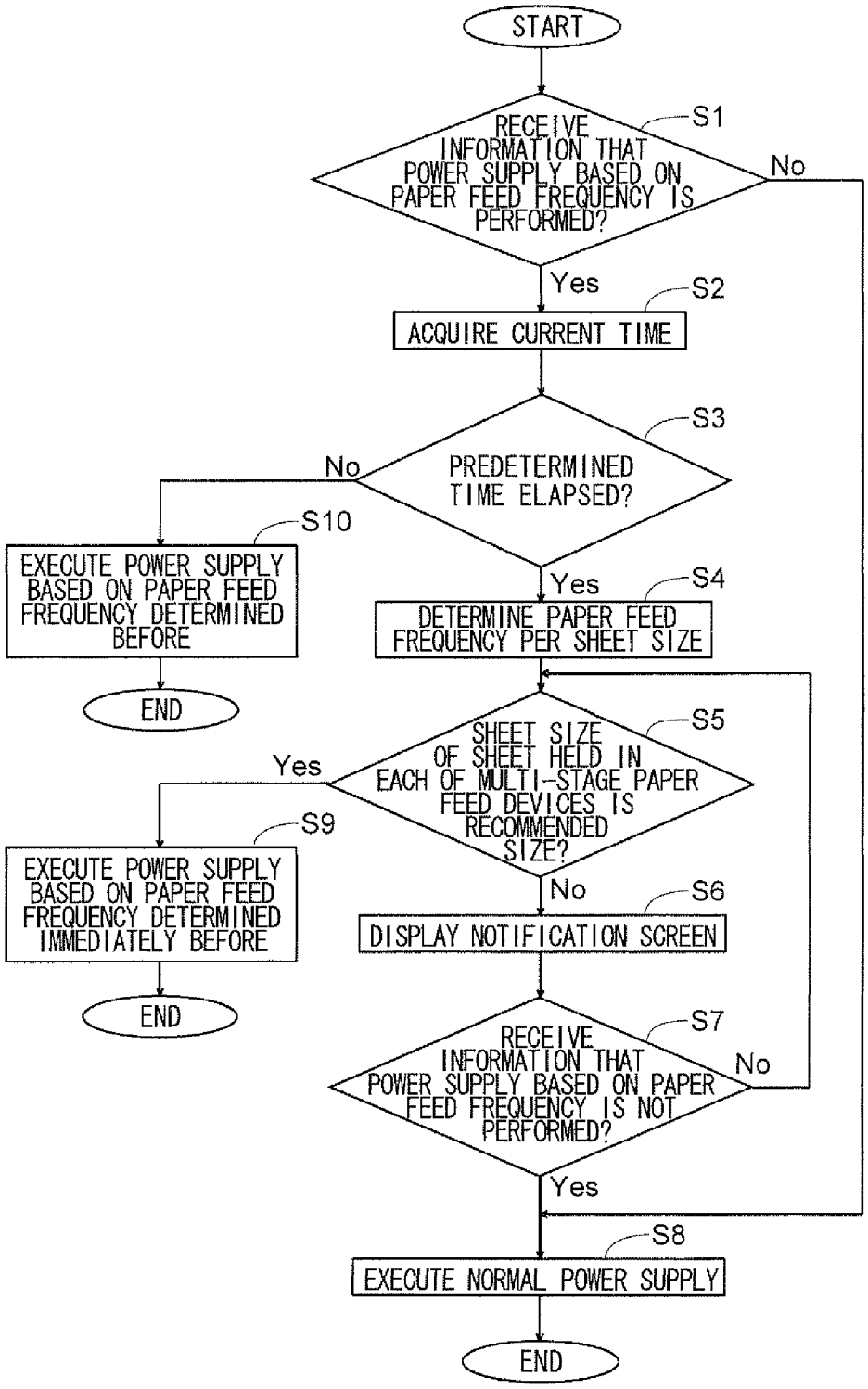
FIG. 7 is a flowchart for illustrating a flow when power supply based on a paper feed frequency is performed in the image forming apparatus shown in FIG. 1.

The flowchart shown in FIG. 7 starts when power is supplied to the image forming apparatus 100. In step S1, the main, control portion 110 first determines whether or not information that the power supply to the multi-stage paper feed devices 108 based on the paper feed frequency is performed is received. As a result of the determination, if the information that the power supply to the multi-stage paper feed devices 108 based on the paper feed frequency is performed is received, the process moves to step S2.

When the process moves to step S2, the main control portion 110 acquires the current time. In step S3, the main control portion 110 determines whether or not a time elapsed since the time when the power supply to the multi-stage paper feed devices 108 based on the paper feed frequency was performed reaches a predetermined time (exceeds it). As a result of the determination, if the time elapsed since the time when the power supply to the multi-stage paper feed devices 108 based on the paper feed frequency was performed reaches the predetermined time, the process moves to step S4.

When the process moves to step S4, the main control portion 110 reads, from the storage portion 114, the number of sheets (the number of sheets fed per sheet size) fed from each of the multi-stage paper feed devices 108 to the engine portion 107 and determines it. In other words, the main control portion 110 determines the paper feed frequency per sheet size.

In step S5, the main control portion 110 determines, based on the output of the sheet size detection sensor 85 corresponding to each of the multi-stage paper feed devices 108 whether or not the paper feed device holding the sheet P of the sheet size whose paper feed frequency (paper feed number) reaches the threshold value is a higher stage paper feed device 108, among the multi-stage paper feed devices 108, (a higher paper feed device 108 that is closer to the engine portion 107) than the paper feed device 108 holding the sheet P of the sheet size whose paper feed frequency does not reach the threshold value. In other words, the main control portion 110 determines whether or not the sheet size of the sheet P held in each of the multi-stage paper feed devices 108 is the recommended size. As a result of the determination, if the sheet size of the sheet P held in each of the multi-stage paper feed devices 108 is not the recommended size (if the paper feed device holding the sheet P of the sheet size whose paper feed frequency reaches the threshold value is not a stage paper feed device 108, among the multi-stage paper feed devices 108, that is closer to the engine portion 107 than the paper feed device 108 holding the sheet P of the sheet size whose paper feed frequency does not reach the threshold value, the process moves to step S6.

When the process moves to step S6, the main control portion 110 instructs the operation panel 101 to provide a notification that the paper feed device holding the sheet P of the sheet size whose paper feed frequency (paper feed number) reaches the threshold value is encouraged to be a higher stage paper feed device 108, among the multi-stage paper feed devices 108, that is closer to the engine portion 107 than the paper feed device 108 holding the sheet P of the sheet size whose paper feed frequency does not reach the threshold value. In other words, the operation panel 101 displays the notification screen IS (see FIG. 5) indicating the sheet size of the sheet P to be held in each of the multi-stage paper feed devices 108.

In step S7, the main control portion 110 determines whether or not information that the power supply to the multi-stage paper feed devices 108 based on the paper feed frequency is not performed is received. As a result of the determination, if the information that the power supply to the multi-stage paper feed devices 108 based on the paper feed frequency is not performed is received, the process moves to step S8. When the process moves to step S8, the power supply portion 170 receives an instruction from the main control portion 110, and performs the normal power supply on all the paper feed devices 108 among the multi-stage paper feed devices 108. In step S1, if the information that the power supply to the multi-stage paper feed devices 108 based on the paper feed frequency is performed is not received, the process also moves to step S8.

On the other hand, in step S7, if the information that the power supply to the multi-stage paper feed devices 108 based on the paper feed frequency is not performed is not received, the process moves to step S5. Then, in step S5, if the sheet size of the sheet P held in each of the multi-stage paper feed devices 108 is changed to be the recommended size, the process moves to step S9. Even if the sheet size of the sheet P held in each of the multi-stage paper feed devices 108 has been the recommended size before, the process moves not to step S6 but to step S9.

When the process moves to step S9 the main control portion 110 instructs the power supply portion 170 to perform the power supply based on the paper feed frequency (paper feed number) that has been determined immediately before. In other words, the power supply portion 170 performs the normal power supply on the paper feed device 108 holding the sheet P of the sheet size whose paper feed frequency reaches the threshold value among the multi-stage paper feed devices 108. Among the multi-stage paper feed devices 108, the power supply portion 170 limits, as compared with the normal power supply, the power supply to Ore paper feed device 108 holding the sheet P of the sheet size whose paper feed frequency does not reach the threshold value, and thereby brings, into the power saving state (sleep state), the paper feed device 108 holding the sheet P of the sheet size whose paper feed frequency does not reach, the threshold value.

In step S3, if the time elapsed since the time when the power supply to the multi-stage paper feed devices 108 based on the paper feed frequency was performed does not reach the predetermined time, the process moves to step S10. Then, the main control portion 110 instructs the power supply portion 170 to perform the power supply based on the paper feed frequency determined before. Hence, the paper feed device 108 on which the normal power supply is performed and the paper feed device 108 in which the power supply is limited have been maintained, and they have not been changed. In other words, when the power supply portion 170 starts the power supply to the multi-stage paper feed devices 108 based on the paper feed frequency, if the time elapsed since the time when, the power supply to the multi-stage paper feed devices 108 based on the paper feed frequency was performed does not reach the predetermined time, the power supply portion 170 performs, among the multi-stage paper feed devices 108, the normal power supply on the paper feed device 108 which has performed the normal power supply before, and maintains the power saving state of the paper feed device 108 which has already been in the power saving state.

As described shove, the image forming apparatus 100 of the present embodiment includes; the engine portion 107 (print portion) that prints an image on the sheet P; the multi-stage paper feed devices 108 that hold the sheet P and feeds the sheet P held to the engine portion 107; the main control portion 110 (sheet size detection portion) that detects the sheet size of the sheet P held in each of the multi-stage paper feed devices 108; a storage portion 114 that stores paper feed frequency data indicating the paper feed frequency to the engine portion 107 per sheet size; the power supply portion 170 that performs, when the paper feed device holding the sheet P of the sheet size whose paper feed frequency reaches the predetermined threshold value is a higher paper feed device 108, among the multi-stage paper feed devices 108, that is closer to the engine portion 107 than the paper feed device 108 holding the sheet P of the sheet size whose paper feed frequency does not reach the threshold value, among the multi-stage paper feed devices 108, the normal power supply on the paper feed device 108 holding the sheet P of the sheet size whose paper feed frequency reaches the predetermined threshold value, and that limits, as compared with the normal power supply, the power supply to the paper feed device 108 holding the sheet of the sheet size whose paper feed frequency does not reach the threshold value so as to bring, into the power saving state, the paper feed device holding the sheet P of the sheet size whose paper feed frequency does not reach the threshold value; and the operation panel 101 (notification portion) that provides a notification that the paper feed device holding the sheet P of the sheet size whose paper feed frequency reaches the threshold value is encouraged to be a higher stage paper feed device 108, among the multi-stage paper feed devices 108, that is closer to the engine portion 107 than the paper feed device 108 holding the sheet P of the sheet size whose paper feed frequency does not reach the threshold value.

In the configuration of the present embodiment, the power supply portion 170 performs the normal power supply on the paper feed device 108 holding the sheet P of a higher paper feed frequency sheet size, and brings, into the power saving state, the paper feed device 108 holding the sheet P of a lower paper feed frequency sheet size. Hence, since the paper feed device 108 holding the sheet P of a lower paper feed frequency sheet size is brought into the power saving state, it is possible to reduce the power consumption. However, when the paper feed device 108 holding the sheet P of a lower paper feed frequency sheet size is a higher stage paper feed device 108 that is closer to the engine portion 107 than the paper feed device 108 holding the sheet P of a higher paper feed frequency sheet size, it is impossible to bring, into the power saving state, the paper feed device 108 holding the sheet P of a lower paper feed frequency sheet size.

Hence, in the configuration of the present embodiment, the operation panel 101 provides a notification that the paper feed device holding the sheet P of the sheet size whose paper feed frequency reaches the threshold value is encouraged to be a higher stage paper feed device 108, among the multi-stage paper feed devices 108, that is closer to the engine portion 107 than the paper feed device 108 holding the sheet P of the sheet size whose paper feed frequency does not reach the threshold value. Thus, even when the paper feed device holding the sheet P of a lower paper feed frequency sheet size is a higher stage paper feed device 108 that is closer to the engine portion 107 than the paper feed device 108 holding the sheet P of a higher paper feed frequency sheet size, the user who receives the notification makes a change such that the paper feed device holding the sheet P of a higher paper feed frequency sheet size is a higher stage paper feed device 108 that is closer to the engine portion 107 than the paper feed device 108 holding the sheet P of a lower paper feed frequency sheet size. In this way, it is possible to bring, into the power saving state, the paper feed device 108 holding the sheet P of a lower paper feed frequency sheet size. Consequently, it is possible to efficiently reduce the power consumption.

In the present embodiment, as described above, the main control portion 110 (control portion) communicates with the multi-stage paper feed devices 108 to recognize the multi-stage paper feed devices 108, and the operation panel 101

(display portion) displays the sheet sizes of the sheets P held in the multi-stage paper feed devices 108 recognized by the main control portion 110. Then, the power supply portion 170 does not completely stop the power supply to the paper feed device 108 in the power saving state among the multi-stage paper feed devices 108, and continues to supply, to the paper feed device 108 in the power saving state, power for making the paper feed device 108 in the power saving state communicate with the main control portion 110. In this way, since the user can grasp the sheet size of the sheet P held in the paper feed device 108 in the power saving state, convenience is enhanced.

In the present embodiment, as described above, the operation panel 101 (operation display portion) receives an instruction to select the sheet size, and, when the sheet size received by the operation panel 101 is the same as the sheet size of the sheet P held in the paper feed device 108 in the power saving state, the power supply portion 170 returns the power supply to the paper feed device 108 in the power saving state to the normal power supply. In this way, since, even when the paper feed device 108 holding the sheet P of a desired sheet size is in the power saving state, the power supply to the paper feed device 108 in the power saving state is returned to the normal power supply only by selecting the desired sheet size, convenience for the user is enhanced.

In the present embodiment, as described above, the operation panel 101 (operation portion) receives the interruption of the power supply to the multi-stage paper feed devices 108 based on the paper feed frequency. While the power supply to the multi-stage paper feed devices 108 based on the paper feed frequency is being performed, if the operation panel 101 receives information that the power supply to the multi-stage paper feed devices 108 based on the paper feed frequency is interrupted, the operation panel 101 returns, among the multi-stage paper feed devices 108, the power supply to the paper reed device 108 to the power saving state to the normal power supply. In this way, since the power supply to the multi-stage paper feed devices 108 based on the paper feed frequency can be easily interrupted, convenience for the user is enhanced.

In the present embodiment, as described above, the operation panel 101 receives whether or not the power supply to the multi-stage paper feed devices 108 based on the paper feed frequency is performed when power is supplied to the image forming apparatus 100. In this way, since the user can previously select whether or not the power supply to the multi-stage paper feed devices 108 based on the paper feed frequency is performed when power is supplied to the image forming apparatus 100, convenience for the user is enhanced.

It should be understood that the embodiment disclosed herein is illustrative in all respects, and not restrictive. The scope of the present disclosure is indicated not by the description of the above embodiment but by the scope of claims, and furthermore, meanings equivalent to the scope of claims and all modifications within the scope are included.

What is claimed is:

1. An image forming apparatus comprising:

a print portion that prints an image on a sheet;

multi-stage paper feed devices that hold the sheet and feed the sheet held to the print portion;

a sheet size detection portion that detects a sheet size of the sheet held in each of the multi-stage paper feed devices;

a storage portion that stores paper feed frequency data indicating a paper feed frequency to the print portion per sheet size;

a power supply portion that performs, when the paper feed device holding the sheet of a sheet size whose paper feed frequency reaches a predetermined threshold value is the paper feed device, among the multi-stage paper feed devices, that is closer to the print portion than the paper feed device holding the sheet of a sheet size whose paper feed frequency does not reach the threshold value, among the multi-stage paper feed devices, normal power supply on the paper feed device holding the sheet of the sheet size whose paper feed frequency reaches the predetermined threshold value, and that limits, as compared with the normal power supply, power supply to the paper feed device holding the sheet of the sheet size whose paper feed frequency does not reach the threshold value so as to bring, into a power saving state, the paper feed device holding the sheet of the sheet size whose paper feed frequency does not reach the threshold value; and a notification portion that provides a notification that the paper feed device holding the sheet of the sheet size whose paper feed frequency reaches the threshold value is encouraged to be the paper feed device, among the multi-stage paper feed devices, that is closer to the print portion than the paper feed device holding the sheet of the sheet size whose paper feed frequency does not reach the threshold value.

2. The image forming apparatus of claim 1 further comprising:

a control portion that communicates with the multi-stage paper feed devices to recognize the multi-stage paper feed devices; and a display portion that displays the sheet sizes of the sheets held in the multi-stage paper feed devices recognized by the control portion, wherein, among the multi-stage paper feed devices, the power supply portion does not completely stop power supply to the paper feed device in the power saving state and continues to supply, to the paper feed device in the power saving state, power for making the paper feed device in the power saving state communicate with the control portion.

3. The image forming apparatus of claim 2, wherein the display portion is an operation display portion that receives an instruction to select the sheet size, and when the sheet size received by the operation display portion is the same as the sheet size of the sheet held in the paper feed device in the power saving state, the power supply portion returns the power supply to the paper feed device in the power saving state to the normal power supply.

4. The image forming apparatus of claim 1 further comprising;

an operation portion that receives interruption of the power supply to the multi-stage paper feed devices based on the paper feed frequency, wherein, while the power supply to the multistage paper feed devices based on the paper feed frequency is being performed, when the operation portion receives information that the power supply to the multi-stage paper feed devices based on the paper feed frequency is interrupted, the power supply portion returns, among the multi-stage paper feed devices, the power supply to the paper feed device in the power saving state to the normal power supply.

5. The image forming apparatus of claim 4, wherein the operation portion receives whether or not the power supply to the multi-stage paper feed devices based on the paper feed frequency is performed when power is supplied to the image forming apparatus.

6. The image forming apparatus of claim 5, wherein, when the power supply portion starts the power supply to the multi-stage paper feed devices based on the paper feed frequency, if a time elapsed since a time when the power supply to the multi-stage paper feed devices based on the paper feed frequency was performed does not reach a predetermined time, the power supply portion performs, among the multi-stage paper feed devices, the normal power supply on the paper feed device which has performed the normal power supply before, and maintains the power saving state of the paper feed device which has already been in the power saving state.

7. A method of controlling an image forming apparatus which includes: a print portion that prints an image on a sheet; multi-stage paper feed devices that hold the sheet and feed the sheet held to the print portion; a sheet size detection portion that detects a sheet size of the sheet held is each of the multi-stage paper reed devices; and a storage portion that stores paper feed frequency data indicating a paper feed frequency to the print portion per sheet size, the method comprising:

a step of determining whether or not the paper feed device holding the sheet of a sheet size whose paper feed frequency reaches a predetermined threshold value is the paper feed device, among the multi-stage paper feed devices, that is closer to the print portion than the paper feed device holding the sheet of a sheet size whose paper feed frequency does not reach the threshold value; and a step in which, when the paper feed device holding the sheet of the sheet size whose paper feed frequency reaches the predetermined threshold value is the paper feed device, among the multi-stage paper feed devices, that is closer to the print portion than the paper feed device holding the sheet of the sheet size whose paper feed frequency does not reach the threshold value, among the multi-stage paper feed devices, normal power supply is performed on the paper feed device holding the sheet of the sheet size whose paper feed frequency reaches the predetermined threshold value, and power supply to the paper feed device holding the sheet of the sheet size whose paper feed frequency does not reach the threshold value is limited, as compared with the normal power supply, so as to bring, into a power saving state, the paper feed device holding the sheet of the sheet size whose paper feed frequency does not reach the threshold value whereas, when the paper feed device holding the sheet of the sheet size whose paper feed frequency reaches the predetermined threshold value is not the paper feed device, among the multi-stage paper feed devices, that is closer to the print portion than the paper feed device holding the sheet of the sheet size whose paper feed frequency does not reach the threshold value, a notification is provided that the paper feed device holding the sheet of the sheet size whose paper feed frequency reaches the threshold value is encouraged to be the paper feed device, among the multi-stage paper feed devices, that is closer to the print portion than the paper feed device holding the sheet of the sheet size whose paper feed frequency does not reach the threshold value.

* * * * *